United States Patent [19]

Henning et al.

[11] Patent Number: 4,598,229

[45] Date of Patent: Jul. 1, 1986

[54] LUMINOUS TUBE COLOR GENERATOR

[75] Inventors: Haden V. Henning; Jerry G. Warthan, both of Arlington, Tex.; John Fajt, Norman, Okla.

[73] Assignee: Lightmasters, Ltd., Dallas, Tex.

[21] Appl. No.: 633,477

[22] Filed: Jul. 23, 1984

[51] Int. Cl.[4] ..... H01J 1/62; H01J 63/04

[52] U.S. Cl. ..... 313/493; 313/485; 313/612; 313/643; 313/54

[58] Field of Search ..... 313/493, 590, 485, 486, 313/609, 629, 635, 610, 611, 612, 631, 643, 54

[56] References Cited

U.S. PATENT DOCUMENTS

| | | | |
|---|---|---|---|
| 2,990,490 | 6/1961 | Heine-Geldern | 313/54 |
| 3,891,883 | 6/1975 | Ahmed | 313/54 |
| 4,199,708 | 4/1980 | Lauwerijssen et al. | 313/493 |
| 4,335,331 | 6/1982 | Watanabe et al. | 315/334 |

FOREIGN PATENT DOCUMENTS

| | | | |
|---|---|---|---|
| 1060766 | 4/1954 | France | 313/612 |
| 0121579 | 9/1979 | Japan | 313/485 |
| 0010361 | 1/1983 | Japan | 313/493 |

*Primary Examiner*—David K. Moore
*Assistant Examiner*—William L. Oen
*Attorney, Agent, or Firm*—Richards, Harris, Medlock & Andrews

[57] ABSTRACT

A luminous tube is provided with three color producing inner tubes and is mounted within a clear outer tube. The luminous gas filling the outer tube also fills the open-ended inner tubes. Each of the color-producing tubes has an electrode to enable the current density to be independently controlled, and thus control of the light-intensity emitted from each of the color-producing tubes. A luminous tube may also be constructed with at least one tube mounted inside an outer tube within a common luminous gas, where the inner tube houses an electrode and has a restricted diameter opening to produce a high-intensity luminous discharge.

5 Claims, 6 Drawing Figures

LUMINOUS TUBE COLOR GENERATOR

TECHNICAL FIELD

This invention relates to the production, utilization and control of luminous structures, and, in particular, to the production of a a multiplicity of desired hues within a luminous gas-filled tube.

BACKGROUND ART

Luminous tubes are vacuum-tight glass tubes fitted with metal electrodes with an appropriate charge of a rare gas, such as neon or argon. When a source of high-voltage electric power is connected to the electrodes, the tube glows with a steady piercing light. Luminous tubes have long been used in a variety of different structures and operating conditions for data display, decoration and the like.

There exists a need for a luminous tube for producing a multiplicity of desired hues within a common gas. This is particularly the case for luminous tubes for use as luminous sources operating at extremely high switching rates for production of displays in real time. In addition, there is a need for a luminous tube producing very high intensity, specific colors at improved efficiencies.

DISCLOSURE OF THE INVENTION

The luminous high intensity tube structure disclosed in one embodiment herein involves a clear glass tube and at least one color producing tube. The clear glass tube is a closed outer tube, the color producing tube is an inner tube mounted at the interior base of the outer tube. The inner tube is open near the top of the outer tube and exposed to the atmosphere of gas in the outer tube. A coating of phosphor on the inside of the inner tube provides for the production of light of the desired hue. Limited colors may also be produced by the use of various gases, not requiring the use of phosphors.

Electrodes are mounted at the bottom of the outer tube and in the inner tube. The electrodes extend through the glass base of the outer tube forming a glass-to-metal seal of a type well known to those skilled in the art of making vacuum tubes. The inner tube has an enlarged diameter portion near the bottom for receiving the electrode. The inner tube has a reduced diameter portion extending from the enlarged diameter portion to about the top of the outer tube. A high intensity light is produced by the high current density resulting from the reduced diameter path.

In a further aspect of the invention, a trio of primary color producing tubes are located within an outer tube and in close proximity to each other to produce at a distance the illusion of selected colors to the observer. The color producing tubes may be fabricated from tubes having a uniform diameter along their length or the reduced diameter high intensity tube described above. Color mixing is accomplished by selecting and adjusting the current applied to the individual color producing tubes to provide the desired hues. Generation of various colors is achieved by optical illusion from observing at a distance the mixing of red, blue and green light produced in the special color producing luminous tubes. Color is produced by the presence of phosphor coatings optimized for emitting red, blue or green light or combinations thereof. Various colors may also be produced in high intensity xenon filled luminous tubes, not using phosphor coatings, but using red, blue or green filters internally to the main tube structure or external filtering for single inner tube structure.

In another embodiment disclosed herein, limited color may also be produced by the use of various gases, not requiring the use of phosphors. A high intensity luminous tube has a clear glass closed outer tube and a clear glass inner tube mounted at the bottom of the outer tube. The inner tube is open near the top of the outer tube and exposed to the atmosphere in the outer tube. One electrode is located at the bottom of the outer tube and another electrode is mounted within an enlarged diameter portion near the bottom of the inner tube. The inner tube has a reduced diameter section extending upward into the outer tube to produce a high current density causing a high intensity light to be produced. A suitable gas mixture, such as neon and krypton 85, is used in the tube to produce light at a relatively high intensity level, in this instance a red-orange light.

BRIEF DESCRIPTION OF THE DRAWINGS

For a further understanding of the present invention and for objects and advantages thereof, reference may now be had to the following description in connection with the accompanying drawings.

DETAILED DESCRIPTION

Figure 1:
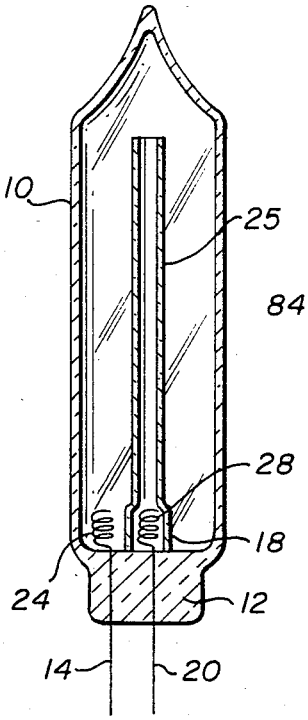
FIG. 1 shows a high intensity luminous tube for AC or DC operation.

A preferred form of the present luminous tube system is shown in FIG. 1. A closed outer tube 10 has an inner tube 25 mounted within outer tube 10. Inner tube 25 is open at the top thereof to the atmosphere of the luminous gas in outer tube 10. The glass envelope of outer tube 10 is closed at the bottom by a glass-to-metal seal 12 and closed at the top by tipping off or sealing the tubulation in the conventional manner.

A conventional glass-to-metal seal 12 is formed around electrode lead wires 14 and 20 which pass through the base of tube 10 for connection to the coiled electrodes 24 and 28. The electrode lead wires 14 and 20 may be made from material well-known in the art, such as Dument alloy wire. The coiled cathode electrode 28 is coated with an emission coating, such as a triple carbonate, barium, strontium and calcium. The emission coating lowers the work function of the electrode surface which improves tube performance, allowing a high current density to be produced from a small electrode.

The inner tube 25 has an enlarged diameter portion or bulb 18 at the bottom for receiving the coiled electrode 28. Tube 25 has a reduced diameter portion extending from the enlarged bulb 18 to the top of the inner tube 25.

High intensity light is produced in the unit of FIG. 1 by the high current density resulting from the small diameter path in the inner tube 25. The High intensity tube 10 does not require that inner tube 25 be phosphor coated. Suitable gas employed for the High intensity tube would be neon mixed with krypton 85 at a level of six millicuries per liter of neon. This causes production of a red-orange light at a relatively high intensity.

The luminous tube of FIG. 1 may be operated in either an AC or DC mode. In AC operation, the electrodes 24 and 28 alternately serve as the anode and cathode. In DC operation, electrode 24 serves as the anode (electron acceptor) and electrode 28 serves as the cathode (electron emitter).

For colored light generation, the inner tube 25 may be coated with phosphor. $P_{22}$ phosphor coating may be employed with a 50% neon gas and 50% krypton gas with two millicuries of krypton 85 per liter of gas. Another gas mixture suitable for operation in color generation includes 50% argon, 50% krypton with two millicuries of krypton 85 per liter of gas. Suitable lamp phosphors for coating the inner tube 25 are produced by Sylvania as Tri-Bond phosphor: red (type 2340), green (type 2291) and blue (type 246).

As an alternative for red color generation, one may use as coating material $P_{22}$ Yttrium Vanadate $YVO_4$:Eu. Another suitable coating would be $YVO_4$:Eu:Bi (modified). For generation of blue color, the coating may be $P_{22}$ AnS:Ag. For green generation the coating would be $P_{22}$ AnCdS:Cu.

Another suitable means for colored light generation uses xenon gas without coating inner tube 25 with phosphor. The broad spectrum light produced in passively filtered to produce the desired color. The filtered light may be produced by making the inner tube 25 the filter element or by fitting a tube-shaped filter over the inner tube 25.

A suitable starter and current control system for use with tubes shown herein is disclosed in application of Haden V. Henning, U.S. Ser. No. 545,639, filed Oct. 26, 1983 and entitled D.C. LUMINOUS TUBE SYSTEM.

Figure 2:
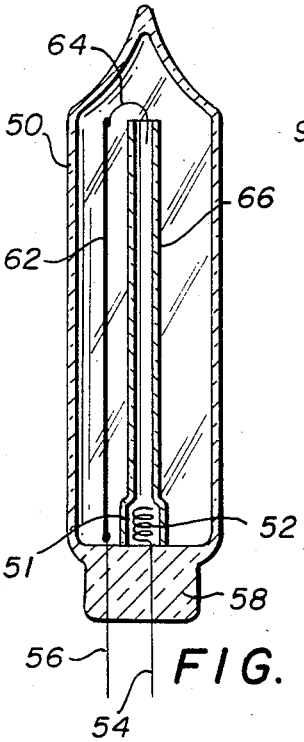
FIG. 2 shows a hi-intensity luminous tube for D.C. operation only.

FIG. 2 discloses a luminous tube structure for D.C. operation. A closed outer tube 50 has an inner tube 66 mounted within outer tube 50. Inner tube 66 is open at the top thereof to the atmosphere of luminous gas in outer tube 50. The glass envelope of outer seal 50 is closed at the bottom by a glass-to-metal seal 58 and closed at the top by tipping off or sealing the tubulation in the conventional manner. Two electrode lead wires 54 and 56 pass through the seal 58 for connection to electrodes 52 and 62, respectively.

The inner tube 66 has an enlarged diameter portion or bulb 51 at the bottom for receiving the coiled electrode 52. The tube 66 has a reduced diameter portion extending from the enlarged bulb 51 to the top of the inner tube 66. Electrode 62 is a stiff wire extending upwardly within tube 50 to the region near the open top of inner tube 66. The straight electrode 62 near the top of the inner tube 66 lowers the firing voltage which is raised by the restricted path within the tube 66. An anchoring wire 64 is shown connecting the end of electrode 62 to the top of inner tube 66, which arrangement is particularly desirable for elongated luminous tubes.

Various colors may be generated by mixing of red, blue and green primary colors in special luminous tubes illustrated in FIGS. 3–6. Colors produced by use of selected phosphors are optimized for emitting respectively red, blue or green color. A higher light level of color may be produced by xenon filled luminous tubes not using phosphor coatings but rather producing the respective red, blue and green colors by filters. In such case, a trio of primary color sources are physically mounted in close proximity to each other. An illusion is produced in which various colors appear as one to an observer at a distance from the source.

Figure 5:
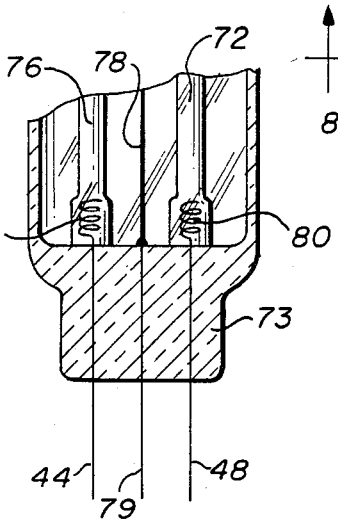
FIG. 5 is a vertical sectional view of the bottom portion of the tube of FIG. 3 taken along lines 5—5 of FIG. 4.
Figure 4:
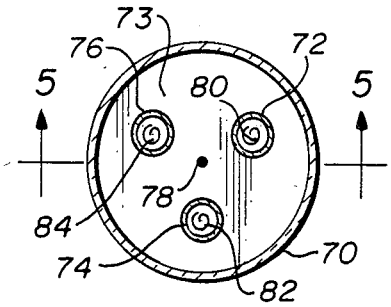
FIG. 4 is a cross section view taken on lines 4—4 of FIG. 3.
Figure 3:
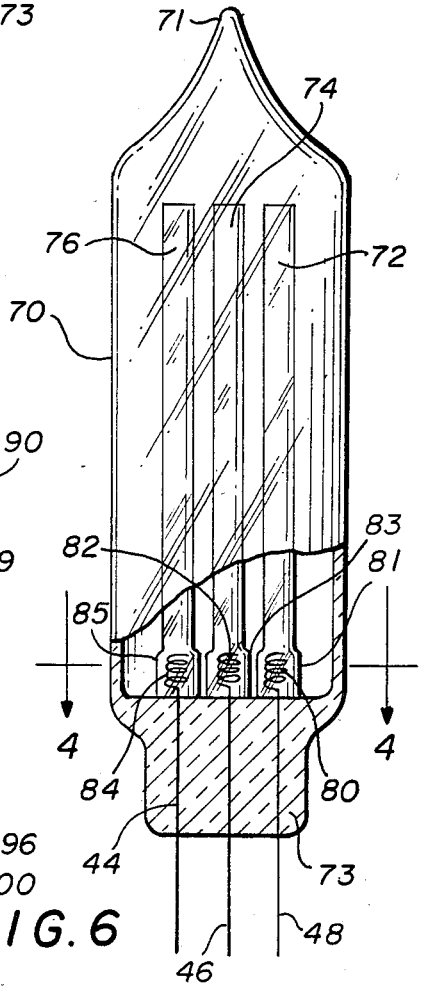
FIG. 3 illustrates an embodiment of the invention involving three color generating tubes in a single closed outer tube.

FIGS. 3, 4 and 5 illustrate a luminous tube structure for color generation through mixing of red, blue and green colors. A clear glass outer tube 70 is closed at the upper end 71 in the usual manner and closed at the lower end by glass-to-metal seal structure 73. Three color producing tubes 72, 74 and 76 are supported 120° apart by seal 73 and extend in a symmetrical array to a height near the top of the tube 70. Tubes 72, 74 and 76 are closed at the bottom but are open at the top thereof to the atmosphere of luminous gas in the tube 70. Tubes 72, 74 and 76 are individually phosphor coated for production of colored lights as above noted. As shown in FIGS. 4 and 5, a common anode electrode 78 extends vertically within the tube 70 and serves as a common electrode for the tubes 72, 74 and 76. Anode electrode 78 extends to the open tops of tubes 72, 74 and 76 in the same way that electrode 62 extends to the open top of inner tube 66 in FIG. 2.

Three electrode lead wires 44, 46 and 48 pass through the seal 73 for connection to the coiled electrodes 84, 82 and 80 respectively. The inner tubes 72, 74 and 76 have enlarged diameter sections 81, 83 and 85 for receiving coiled electrodes 80, 82 and 84, respectively. As shown in FIG. 5, electrode lead wire 79 passes through the seal 73 for connection to anode electrode 78.

Figure 6:
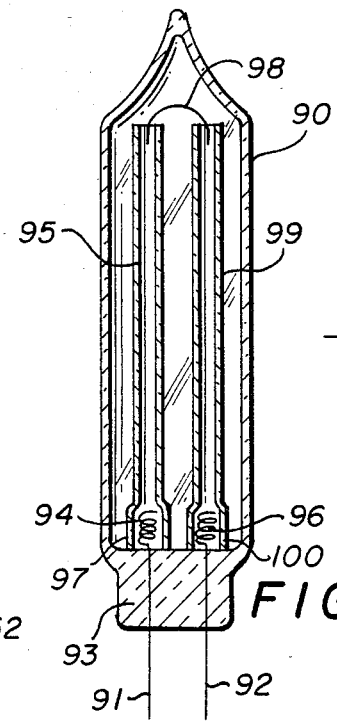
FIG. 6 illustrates an embodiment of the invention involving two inner color generating tubes.

FIG. 6 illustrates a further embodiment wherein an outer tube 90 houses two inner tubes 95 and 99. The glass envelope of outer tube 90 is closed at the bottom by a glass-to-metal seal 93 and closed at the top in the conventional manner described above. Two electrode lead wires 91 and 92 pass through the seal 93 for connection to coiled electrodes 94 and 96, respectively. The inner tubes 95 and 99 have enlarged diameter portions or bulbs 97 and 100 for receiving the coiled electrodes 94 and 96, respectively. A wire 98 mechanically couples the upper ends of tubes 95 and 99. Tubes 95 and 99 are individually phosphor coated for production of colored lights as above noted. Depending upon the coating in tubes 95 and 99, various colors may be produced or a single color of higher intensity light can be produced by the two tubes similarly coated.

Having described the invention in connection with certain specific embodiments thereof, it is to be understood that further modifications may now suggest themselves to those skilled in the art, and it is intended to cover such modifications as fall within the scope of the appended claims.

We claim:

1. A gas-filled luminous tube structure for producing light of variable hue, comprising:

an outer tube sealed at one end to form a base and sealed at the opposite end so as to contain a luminous gas;

three inner tubes mounted inside said outer tube and on said base, said inner tubes extending upward from said base and terminating with open ends inside said outer tube;

an electrode located inside each of said inner tubes at said base end, and a common electrode located inside said outer tube and outside said inner tubes, said electrodes extending outside said outer tube through said base to enable connection to an electric power source;

means associated with each inner tube for producing light having the primary colors of red, green, and blue, such that each of said three inner tubes produces one of said primary colors; and means for controlling the current through each of said inner tube electrodes independently, thereby enabling the structure to produce any color of light which is composed of said primary colors.

2. The luminous tube structure of claim 1, wherein each of said inner tubes is coated with a phosphor which emits light having one of said primary colors when said luminous gas in said inner tube is ionized.

3. The luminous tube structure of claim 1, wherein each of said inner tubes includes a colored filter element so as to allow each of said inner tubes to emit light having one of said primary colors when said luminous gas in said inner tube is ionized.

4. The luminous tube structure of claim 1, wherein said inner tubes are mounted apart on said base at 120° spacing around the longitudinal axis of said outer tube.

5. A gaseous discharge lamp for producing light of selectively variable hue, comprising:

a cylindrical outer glass tube having a sealed base and a sealed end opposite said base, said outer tube containing a gas which emits light when ionized;

three cylindrical inner glass tubes mounted on said base inside said outer tube and spaced apart at 120°, said inner tubes extending upward from said base and terminating with open ends inside said outer tube;

a phosphorous coating on each of said inner tubes such that each of said inner tubes emits light having one of the primary colors of red, blue, and green when said gas is ionized;

an electrode located inside each of said inner tubes at said base for providing independent control of current flowing through each of said inner tubes, thereby controlling the intensity of each of said primary light colors to enable the lamp to produce any color of light which is composed of said primary colors; and a common electrode located inside said outer tube and outside said inner tubes, said electrodes and said common electrode extending outside the lamp through said base for connection to an electric power source.

* * * * *